US008498431B2

(12) United States Patent
Akino et al.

(10) Patent No.: US 8,498,431 B2
(45) Date of Patent: Jul. 30, 2013

(54) CAPACITOR MICROPHONE

(75) Inventors: Hiroshi Akino, Tokyo (JP); Hiroaki Furuya, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 139 days.

(21) Appl. No.: 12/943,378

(22) Filed: Nov. 10, 2010

(65) Prior Publication Data

US 2011/0150246 A1 Jun. 23, 2011

(30) Foreign Application Priority Data

Dec. 22, 2009 (JP) ..... 2009-290693

(51) Int. Cl.
*H04R 3/00* (2006.01)

(52) U.S. Cl.
USPC ..... 381/113; 381/112

(58) Field of Classification Search
USPC ..... 381/113, 111, 361, 384; 323/232
See application file for complete search history.

(56) References Cited

U.S. PATENT DOCUMENTS

2005/0185807 A1* 8/2005 Akino ..... 381/174
2005/0220314 A1* 10/2005 Lang et al. ..... 381/113
2005/0231873 A1* 10/2005 Nell ..... 361/92

FOREIGN PATENT DOCUMENTS

JP 9-121533 5/1997
JP 09-121533 A 5/1997
JP 2008-283399 A 11/2008

* cited by examiner

*Primary Examiner* — Fan Tsang
*Assistant Examiner* — Eugene Zhao
(74) *Attorney, Agent, or Firm* — Whitham Curtis Christofferson & Cook, PC

(57) ABSTRACT

A capacitor microphone includes: a capacitor microphone unit including a diaphragm that vibrates upon receiving sound waves and a fixed electrode arranged opposite to the diaphragm with a space therebetween; and a polarization voltage generating circuit that generates polarization voltage to be applied across the diaphragm and the fixed electrode. The polarization voltage generating circuit includes an oscillating circuit that alternately turns on and off DC power, coils to boost the voltage of the power alternately turned on and off, and a DC boosting circuit including a rectifying circuit that rectifies the boosted voltage. The coils are formed of two inductors that are electromagnetically coupled and are provided with an electromagnetic coupling adjusting unit with which the level of electromagnetic coupling between the two inductors is adjusted to adjust the polarization voltage.

7 Claims, 5 Drawing Sheets

CAPACITOR MICROPHONE

BACKGROUND OF THE INVENTION

1. Field of the Invention

The present invention relates to a capacitor microphone including a polarization voltage generating circuit, and more particularly to a capacitor microphone including a polarization voltage generating circuit in which polarization voltage can be controlled.

2. Description of the Related Art

Capacitor microphones generally include a capacitor microphone unit mainly including a diaphragm that vibrates upon receiving sound waves and a fixed electrode arranged to be opposite to the diaphragm. A peripheral portion of the diaphragm is attached to a diaphragm holding ring with appropriate extension force applied to the diaphragm. A ring-shaped spacer is provided between the fixed electrode and a portion of the diaphragm attached to the diaphragm holding ring, thereby providing a minute space defined by the thickness of the spacer between the fixed electrode and the diaphragm. The diaphragm and the fixed electrode are incorporated in a unit casing of the microphone unit along with other elements such as an insulating base, a field effect transistor (FET) serving as an impedance converter, and a circuit board. The elements are positioned and fixed in the unit casing.

The diaphragm is connected to, for example, the anode side of a power source for polarization via the diaphragm holding ring and the unit casing. The fixed electrode is connected to, for example, the cathode side of the power source for polarization via a leading terminal penetrating the insulating base to protrude therefrom. Thus, polarization voltage is applied across the diaphragm and the fixed electrode, whereby a capacitor is formed by the diaphragm and the fixed electrode.

When the diaphragm vibrates upon receiving sound waves, the distance between the diaphragm and the fixed electrode changes and the capacity of the capacitor changes. This is output as a change in current across the diaphragm and the fixed electrode. Impedance of such an output is extremely high. Thus, an output from the impedance converter formed by the FET, which lowers the impedance, serves as an output from the microphone unit.

The sensitivity of the capacitor microphone having the structure described above depends on the polarization voltage applied across the diaphragm and the fixed electrode. Higher polarization voltage is directly related to higher sensitivity. Therefore, polarization voltage is generated by increasing DC power voltage by a DC boost circuit, i.e., a DC-DC converter. Unfortunately, due to other circuits in the microphone, the DC-DC converter is only capable of receiving current of 1 mA or lower. Thus, the polarization voltage cannot be increased over a certain level. To further increase the polarization voltage, the DC-DC converter is provided with a rectifying circuit of a voltage multiplier configuration. FIG. 5 exemplarily illustrates a polarization voltage generating circuit, included in a conventional capacitor microphone, in which a rectifying circuit of the DC-DC converter has a voltage multiplier configuration.

The polarization voltage generating circuit illustrated in FIG. 5 is configured as a DC-DC converter that has a power input terminal 10 connecting to a phantom power source. The polarization voltage generating circuit mainly includes an oscillating circuit 12 and a rectifying circuit 14 of a voltage multiplier configuration. The oscillating circuit 12 is mainly composed of a transistor TR. A variable resistor VR is connected between the power input terminal 10 and the collector of the transistor TR. A capacitor C5 is connected between the power input terminal 10 and the emitter of the transistor TR. A resistor R is connected between the collector and the base of the transistor TR. A coil L2 is connected between the emitter of the transistor TR and earth. The base of the transistor TR is connected to one end of a capacitor C4 and the emitter of the transistor TR is connected to one end of a coil L1. The other ends of the capacitor C4 and the coil L1 are connected with each other. Thus, the capacitor C4 and the coil L1 are connected in series between the base and the emitter of the transistor TR.

The coils L1 and L2 are electromagnetically inductively coupled by, for example, being wound around a common core. The oscillating circuit 12 alternately oscillates. The coils L1 and L2 are electromagnetically inductively coupled. The turn ratio between the coils L1 and L2 is approximately 1 to 8. Thus, DC voltage of about 5 V input through the power input terminal 10 is boosted to AC voltage of about 40 V. This AC voltage is converted into high DC voltage by the rectifying circuit 14 of a voltage multiplier configuration described below. The current flowing through the oscillating circuit 12 can be adjusted by the variable resistor VR to obtain appropriate polarization voltage as described below.

The rectifying circuit 14 of a voltage multiplier configuration includes four diodes D1 to D4 and three capacitors C1 to C3. The four diodes are connected in series in the forward direction between the earth and an output terminal 16 in order of D4 to D1 from the earth to the output terminal 16. Thus, the anode of the diode D4 is connected to the earth while the cathode of the diode D1 is connected to the output terminal 16. The capacitor C1 is connected between a connection point of the diodes D2 and D3 and the output terminal 16. The capacitor C2 is connected between connection points of the diodes D1 and D2 and the diodes D3 and D4. The capacitor C3 is connected between a connection portion of the diodes D3 and D4 and a connection portion of the capacitor C4 and the coil L1. Thus, the rectifying circuit 14 has a voltage tripler configuration. Therefore, the AC voltage of about 40 V from the oscillating circuit 12 is boosted to DC voltage of about 100 to 120 V. The DC voltage obtained by the boosting is output from the output terminal 16 as polarization voltage of the capacitor microphone directly or after being smoothed by a smoothing circuit (not illustrated).

Japanese Patent Application Publication H9-121533 discloses a polarization voltage generating circuit similar to that illustrated in FIG. 5.

A conventional capacitor microphone having the polarization voltage generating circuit as illustrated in FIG. 5 obtains appropriate polarization voltage by adjusting current flowing through the transistor TR for oscillation using the variable resistor VR, as described above. Operating condition of the oscillating circuit 12 fluctuates because the current flowing through the transistor TR is variable. Therefore, the current that can be supplied to the polarization voltage generating current cannot be specified or is limited. Thus, individual difference in consumption current of the microphone may be produced and the output voltage from the output terminal 16 may fluctuate. The same problem occurs when other conditions such as coupling level of the coils L1 and L2 change.

SUMMARY OF THE INVENTION

The present invention is made in view of the problem of the conventional technique and an object of the present invention is to provide a capacitor microphone that allows the stabilization of the polarization voltage output by eliminating the individual difference in current consumption of the oscillating circuit included in a polarization voltage generating circuit while allowing the polarization voltage to be adjusted by adjusting the electromagnetic coupling of two inductors (coils) in the oscillating circuit.

A capacitor microphone according to an aspect of the present invention includes: a capacitor microphone unit including a diaphragm that vibrates upon receiving sound waves and a fixed electrode arranged opposite to the diaphragm with a space therebetween; and a polarization voltage generating circuit that generates polarization voltage to be applied across the diaphragm and the fixed electrode. The polarization voltage generating circuit includes an oscillating circuit that alternately turns on and off DC power, coils that are electromagnetically coupled to each other to boost the voltage of the power alternately turned on and off, and a DC boosting circuit including a rectifying circuit that rectifies the boosted voltage. The coils are formed of two inductors that are electromagnetically coupled and are provided with an electromagnetic coupling adjusting unit with which the level of electromagnetic coupling between the two inductors is adjusted to adjust the polarization voltage.

The electromagnetic coupling adjusting unit may be: formed of a magnetic material provided across the two inductors and the level of electromagnetic coupling between the two inductors may be adjusted by adjusting the position of the magnetic material with respect to the two inductors.

The electromagnetic coupling adjusting unit may be formed of an electromagnetic inductive coupling coil provided across the two inductors and the level of electromagnetic coupling between the two inductors may be adjusted by adjusting the position of the electromagnetic inductive coupling coil with respect to the two inductors.

A current regulative element may be provided between a DC power input terminal and the oscillating circuit.

A constant voltage element may be provided between the DC power input terminal and the oscillating circuit.

The oscillating circuit in the polarization voltage generating circuit alternately turns on and off the DC power. The voltage of the power that is turned on and off is boosted by the two inductors electromagnetically coupled to each other. The boosted voltage is rectified by the rectifying circuit into DC voltage. The DC voltage is applied across the diaphragm and the fixed electrode as polarization voltage. The level of electromagnetic coupling between the two inductors can be adjusted to adjust the polarization voltage. The adjustment of the level of electromagnetic coupling between the two inductors causes no change of the operation condition of the oscillating circuit. Therefore, current supplied to the polarization voltage generating circuit is stabilized and thus, polarization voltage to be generated is stabilized.

The electromagnetic coupling adjusting unit is formed of a magnetic material provided across the two inductors. The level of electromagnetic coupling between the two inductors is adjusted by adjusting the position of the magnetic material with respect to the two inductors. This structure allows the polarization voltage to be adjusted easily.

The polarization voltage can be adjusted easily also when the electromagnetic coupling adjusting unit is formed of an electromagnetic inductive coupling coil provided across the two inductors and the level of electromagnetic coupling between the two inductors is adjusted by adjusting the position of the electromagnetic inductive coupling coil with respect to the two inductors.

The polarization voltage to be generated can be further stabilized by providing a current regulative element or a constant voltage element between the DC power input terminal and the oscillating circuit.

DETAILED DESCRIPTION OF THE PREFERRED EMBODIMENTS

Figure 5:
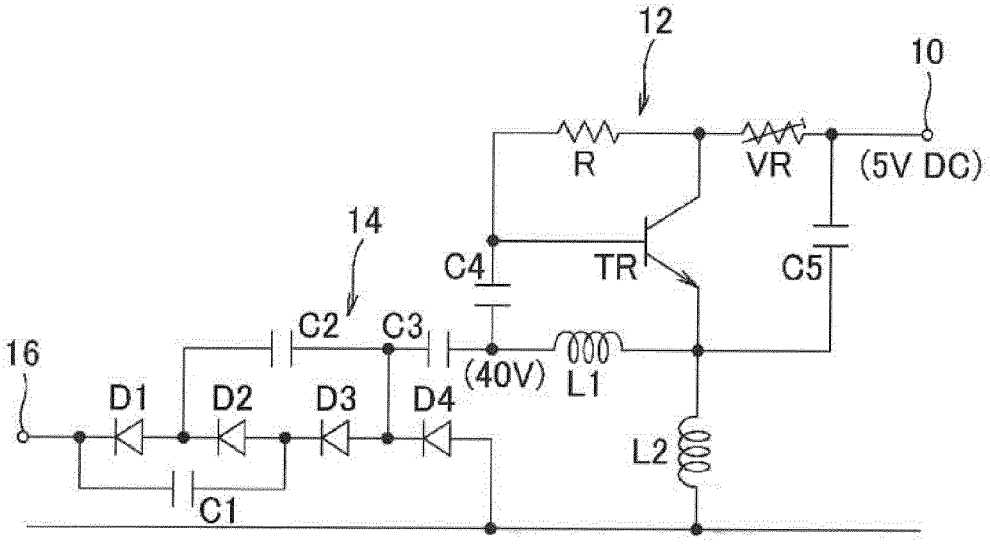
RELATED ART FIG. 5
FIG. 5 is a circuit diagram of an example of a polarization voltage generating circuit used in a conventional capacitor microphone.

An embodiment of a capacitor microphone according to the present invention is described below with reference to some of the accompanying drawings. Note that the feature of the present invention lies in the structure of a polarization voltage generating circuit and therefore the description is given mainly thereto. Elements similar to those in the conventional example illustrated in FIG. 5 are given the same reference numerals.

Figure 1:
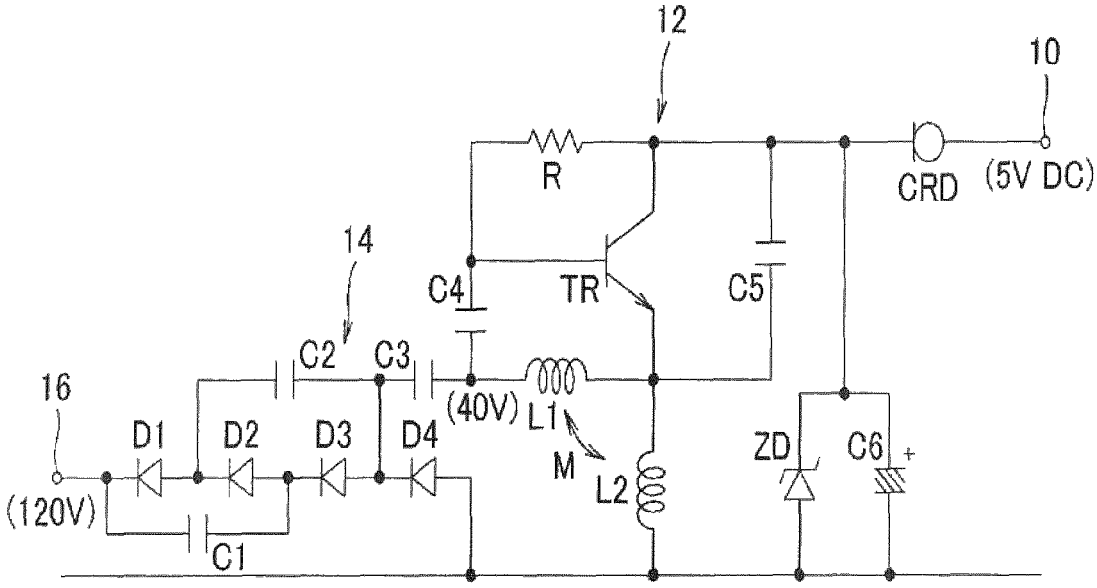
FIG. 1 is a circuit diagram of an example of a polarization voltage generating circuit used in a capacitor microphone according to the present invention.

In FIG. 1, a polarization voltage generating circuit is configured as a DC-DC converter including a power input terminal 10 connecting to a phantom power source. The polarization voltage generating circuit mainly includes an oscillating circuit 12, a rectifying circuit 14 of a voltage multiplier configuration, a current regulative diode CRD, and a Zener diode ZD. The oscillating circuit 12 is mainly composed of a transistor TR that is an active element. The power input terminal 10 is connected to the collector of the transistor TR via the current regulative diode CRD so that constant current of approximately 1 mA flows through the transistor TR. The Zener diode ZD is connected between the collector of the transistor TR and earth so that a constant voltage is applied to the collector of the transistor TR. The Zener diode ZD and a capacitor C6 are connected in parallel.

A capacitor C5 is connected between the collector and the emitter of the transistor TR. A resistor R is connected between the collector and the base of the transistor TR. A coil L2 is connected between the emitter of the transistor TR and the earth. The base of the transistor TR is connected to one end of a capacitor C4. The emitter of the transistor TR is connected to one end of a coil L1. Other ends of the capacitor C4 and the coil L1 are connected with each other. Thus, the capacitor C4 and the coil L1 are connected in series between the base and the emitter of the transistor TR.

Figure 2:
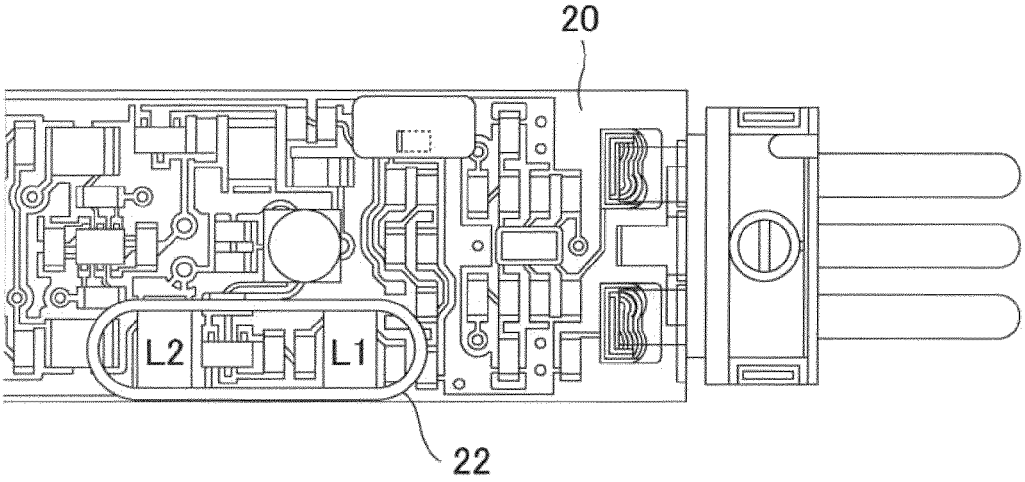
FIG. 2 is a plan view of an example of an adjusting unit for electromagnetic coupling between two inductors in the polarization voltage generating circuit.
Figure 4:
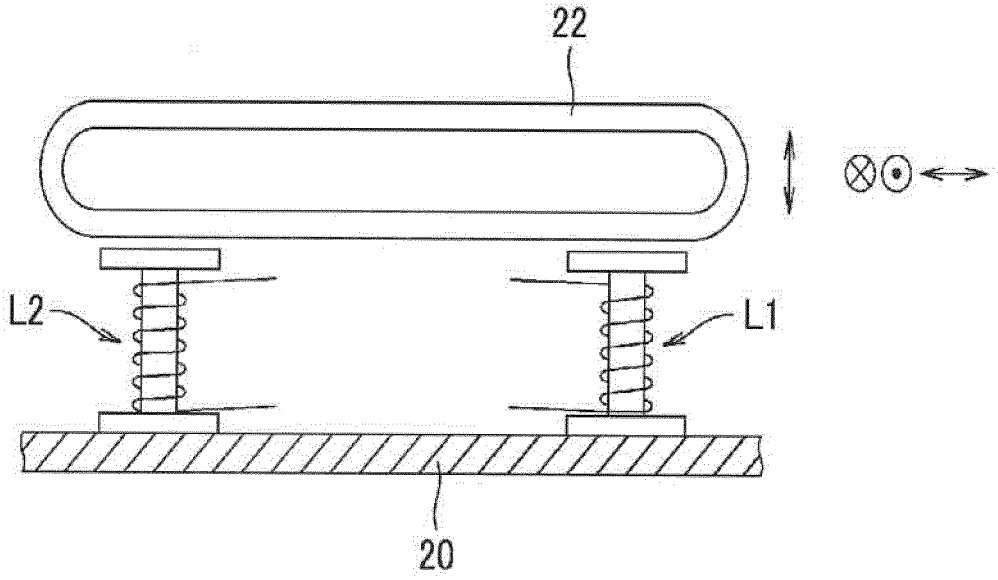
FIG. 4 is a front view schematically illustrating the example of the adjusting unit for electromagnetic coupling between two inductors.

The coils L1 and L2 are wound around different cores as illustrated in FIGS. 2 and 4. The cores of the coils L1 and L2 are electromagnetically inductively coupled with each other with, for example, a wiring pattern formed on a circuit board 20 serving as an electromagnetic inductive coupling coil or with magnetic fluxes from the cores of the coils L1 and L2 being exchanged therebetween. The oscillating circuit 12 alternately oscillates with the emitter output from the transistor TR returning to the base of the transistor TR via the coil L1 and the capacitor C4. The turn ratio between the coils L1 and L2, which are electromagnetically-inductively coupled, is approximately 1 to 8. Thus, DC voltage of about 5 V input through the power input terminal 10 is boosted to AC voltage of about 40 V. This AC voltage is converted into high DC voltage by the rectifying circuit 14 of a voltage multiplier configuration described below. The inductances of the coils L1 and L2 are about 1 mH and 120 μH, respectively. The two coils L1 and L2, i.e., the two inductors have an electromagnetic coupling adjustment unit with which the level of electromagnetic coupling therebetween is adjusted. Thus, the polarization voltage applied across the diaphragm and the fixed electrode of the capacitor microphone can be adjusted. The electromagnetic coupling adjustment unit is described in detail below.

The rectifying circuit 14 of a voltage multiplier configuration includes four diodes D1 to D4 and three capacitors C1 to C3. The four diodes are connected in series between the earth and an output terminal 16 in order of D4 to D1 from the earth to the output terminal 16. Thus, the anode of the diode D4 is connected to the earth while the cathode of the diode D1 is connected to the output terminal 16. The capacitor C1 is connected between a connection point of the diodes D2 and D3 and the output terminal 16. The capacitor C2 is connected between connection points of the diodes D1 and D2 and the diodes D3 and D4. The capacitor C3 is connected between a connection portion of the diodes D3 and D4 and a connection portion of the capacitor C4 and the coil L1. Thus, the rectifying circuit 14 has a voltage tripler configuration. Therefore, the AC voltage of about 40 V from the oscillating circuit 12 is boosted to DC voltage of 100 to 120 V. The DC voltage obtained by the boosting is output from the output terminal 16 as polarization voltage for the capacitor microphone directly or after being smoothed by a smoothing circuit (not illustrated.)

A specific example of the electromagnetic coupling adjustment unit is described below with reference to FIGS. 2, 3A, and 3B. The electromagnetic coupling adjustment unit is a magnetic material or an electromagnetically inductively coupling coil provided across the two inductors, i.e., the coils L1 and L2. The level of electromagnetic coupling is adjusted by adjusting the position of the magnetic material or the electromagnetic inductive coupling coil with respect to the coils L1 and L2. The circuit board 20 incorporated in the microphone is illustrated in FIG. 2. The DC boost circuit as illustrated in FIG. 1 is installed in the circuit board 20 and the coils L1 and L2 are installed while being apart from each other with an appropriate distance. The electromagnetic coupling adjustment unit in FIG. 2 is formed of an electromagnetic inductive coupling coil 22 of a single turn.

As is also illustrated in FIG. 4, the electromagnetic inductive coupling coil 22 is an oval endless coil having a size large enough to include the two coils L1 and L2 arranged while being apart from each other for a certain distance. When the electromagnetic inductive coupling coil 22 is moved closer to the two coils. L1 and L2, the electromagnetic coupling between the coils L1 and L2 is canceled out, whereby the polarization voltage output from the output terminal 16 of the polarization voltage generating circuit illustrated in FIG. 1 is decreased. Alternatively, the winding direction or the direction of connection of the two coils L1 and L2 can be so set that the polarization voltage increases when the electromagnetic inductive coupling coil 22 is moved closer to the two coils L1 and L2.

The direction to which the electromagnetic inductive coupling coil 22 is moved for adjusting, the level of electromagnetic coupling between the coils L1 and L2 can be arbitrarily set. The position of the electromagnetic-coupling adjustment coil 22 with respect to the coils L1 and L2 can be adjusted by moving the electromagnetic coupling adjustment coil 22 in the center axis direction of the cores of the coils L1 and L2 (vertical direction as viewed in FIG. 4) or the direction orthogonal to the center axis direction (the direction orthogonal to the plane of the paper, i.e., the horizontal direction as viewed in FIG. 4.)

Figure 3A:
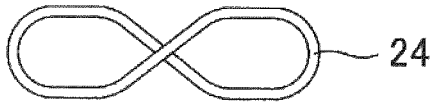
FIGS. 3A and 3B are each a plan view of a modification of the adjusting unit for electromagnetic coupling between two inductors.

An electromagnetic inductive coupling coil 24 as illustrated in FIG. 3A may be used instead of the electromagnetic inductive coupling coil 22 illustrated in FIG. 2. The electromagnetic inductive coupling coil 24 is formed by twisting the electromagnetic inductive coupling coil 22 once, thereby intersecting at the center portion in the longitudinal direction. The respective looped portions on both sides of the intersecting portion are opposed to the two coils L1 and L2. When the electromagnetic inductive coupling coil 24 is moved closer to the two coils L1 and L2, the electromagnetic coupling between the coils L1 and L2 is strengthened to increase the polarization voltage output from the output terminal 16 of the polarization voltage generating circuit illustrated in FIG. 1. Also with the electromagnetic inductive coupling coil 24, the winding direction or the direction of connection of the two coils L1 and L2 can be so set that the polarization voltage decreases when the electromagnetic coupling adjustment coil 24 is moved closer to the two coils L1 and L2. The direction to which the electromagnetic coupling adjustment coil 24 is moved can be arbitrarily set.

Figure 3B:
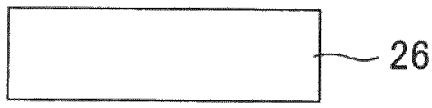

FIG. 3B illustrates an example of an electromagnetic coupling adjustment unit formed by a plate-like magnetic material 26. An area of the magnetic material 26 is large enough to include the two coils L1 and L2 as viewed in a planer direction. As the magnetic material 26 is moved closer to the two coils L1 and L2, the electromagnetic coupling between the coils L1 and L2 is canceled out, whereby the polarization voltage output from the output terminal 16 of the polarization voltage generating circuit illustrated in FIG. 1 is decreased.

In the embodiment described above, the polarization voltage can be adjusted by adjusting the level of electromagnetic coupling between the two inductors, i.e., the coils L1 and L2. The adjustment of the level of electromagnetic coupling between the coils L1 and L2 for adjusting the polarization voltage causes no change in the operating condition of the oscillator 12. Thus, the current to be supplied to the polarization voltage generating circuit can be stabilized and thus, polarization voltage to be generated can be stabilized.

In addition, in the above-described embodiment, the current regulator diode CRD is connected between the DC power input terminal 10 and the oscillating circuit 12. Thus, the current to be supplied to the oscillating circuit 12 and thus, polarization voltage to be generated can be stabilized further.

Moreover, the Zener diode ZD is connected between the DC power input terminal 10 and the oscillating circuit 12. Thus, operating voltage of the oscillating circuit 12 is stabilized and thus, polarization voltage to be generated can be stabilized even further.

As described above, the individual difference in consumption current of the oscillating circuit 12 of the polarization voltage generating circuit can be eliminated.

In the illustrated embodiment, DC voltage is input to the power input terminal 10 from the phantom power source. Alternatively, a battery incorporated in the microphone can also be used as the power source.

The rectifying circuit 14 of a voltage multiplier configuration may multiply a supplied voltage by a factor arbitrarily set. The factor may be two or three or more.

What is claimed is:

1. A capacitor microphone comprising:

a capacitor microphone unit including a diaphragm that vibrates upon receiving sound waves and a fixed electrode arranged opposite to the diaphragm with a space therebetween; and a polarization voltage generating circuit that generates polarization voltage to be applied across the diaphragm and the fixed electrode, wherein the polarization voltage generating circuit includes:

an oscillating circuit that alternately turns on and off DC power, coils that are electromagnetically coupled to each other to boost a voltage of a power alternately turned on and off, and a DC boosting circuit including a rectifying circuit that rectifies a boosted voltage, and the coils are formed of two inductors that are electromagnetically coupled and are provided with an electromagnetic coupling adjusting unit with which a level of electromagnetic coupling between the two inductors is adjusted to adjust the polarization voltage, wherein the electromagnetic coupling adjusting unit is formed of a magnetic material provided across the two inductors and the level of electromagnetic coupling between the two inductors is adjusted by adjusting the position of the magnetic material with respect to the two inductors.

2. The capacitor microphone according to claim 1, wherein the electromagnetic coupling adjusting unit is formed of an electromagnetic inductive coupling coil provided across the two inductors and the level of electromagnetic coupling between the two inductors is adjusted by adjusting the position of the electromagnetic inductive coupling coil with respect to the two inductors.

3. The capacitor microphone according to claim 2, wherein the electromagnetic inductive coupling coil is a coil of a single turn.

4. The capacitor microphone according to claim 1, wherein the rectifying circuit is a rectifying circuit of a voltage multiplier configuration.

5. The capacitor microphone according to claim 1, wherein the oscillating circuit includes a transistor as an active element for oscillation.

6. The capacitor microphone according to claim 1, wherein a current regulative element is provided between the DC power and the oscillating circuit.

7. The capacitor microphone according to claim 1, wherein a constant voltage element is provided between the DC power and the oscillating circuit.

* * * * *